United States Patent [19]

Brundiek

[11] 4,339,086

[45] * Jul. 13, 1982

[54] GRINDING PAN BEARING ARRANGEMENT AND DRIVE OF A ROLLER MILL

[75] Inventor: Horst Brundiek, Neuss, Fed. Rep. of Germany

[73] Assignee: Loecshe GmbH Company, Dusseldorf, Fed. Rep. of Germany

[ * ] Notice: The portion of the term of this patent subsequent to Aug. 19, 1997, has been disclaimed.

[21] Appl. No.: 151,930

[22] Filed: May 21, 1980

Related U.S. Application Data

[63] Continuation of Ser. No. 870,092, Jan. 17, 1978, Pat. No. 4,218,023.

[30] Foreign Application Priority Data

Jan. 28, 1977 [DE] Fed. Rep. of Germany ..... 2703535

[51] Int. Cl.³ ..... B02C 15/00

[52] U.S. Cl. ..... 241/121; 308/9

[58] Field of Search ..... 241/110, 117, 118, 119, 241/120, 121, 122; 308/5 R, 9

[56] References Cited

U.S. PATENT DOCUMENTS

| | | | |
|---|---|---|---|
| 2,192,310 | 3/1940 | Hartshorn | 241/120 X |
| 2,689,689 | 9/1954 | Engler | 241/121 |
| 2,875,959 | 3/1959 | Calkins | 241/119 X |
| 3,366,338 | 1/1968 | Barton | 241/117 |
| 3,656,695 | 4/1972 | Bacharach | 241/117 X |
| 3,658,264 | 4/1972 | Schauer | 241/121 |
| 3,675,977 | 7/1972 | Arsenius et al. | 308/9 |
| 3,799,628 | 3/1974 | Van Gaasbeek et al. | 308/5 R |
| 4,155,511 | 5/1979 | Kartman et al. | 241/117 |

*Primary Examiner*—James M. Meister
*Assistant Examiner*—Robert P. Olszewski
*Attorney, Agent, or Firm*—Holman & Stern

[57] ABSTRACT

The specification describes a roller mill comprising a rotary grinding pan and grinding rollers adapted to roll on this grinding pan and which are journalled stationarily though with a provision for vertical pivoting. In accordance with the invention the grinding pan is supported by a plurality of hydrostatic axial individual bearings, which are arranged substantially symmetrically with respect to the grinding pan and take up all vertical loads. There are also provided a plurality of hydrostatic radial bearings arranged substantially symmetrically around the periphery of the grinding pan to guide and take up radial forces on the grinding pan.

6 Claims, 4 Drawing Figures

3
2
1
4
5
8
5
7
12
21
14
6
17
18
15
16
15a

GRINDING PAN BEARING ARRANGEMENT AND DRIVE OF A ROLLER MILL

This application is a continuation of application Ser. No. 870,092 filed Jan. 17, 1978, now U.S. Pat. No. 4,218,023, issued Aug. 19, 1980.

BRIEF SUMMARY OF THE INVENTION

The invention relates to a roller mill comprising a rotary grinding pan and grinding rollers adapted to roll on this grinding pan and which are journalled stationarily though with a provision for vertical pivoting.

In the last few decades the power, dimensions and weight of roller mills have substantially grown. This trend particularly affects the transmissions, which have had to be designed for larger and larger loads, since they comprised the axial thrust bearing, which serves for taking up the grinding pressure. In the case of the prior art mill design the grinding forces, produced by the rollers, were taken up by an axial thrust bearing, which was fitted in the housing of a mill transmission. The axial loads have increased in the course of mill development to such a degree that there are constantly more exacting requirements as regards the stiffness of the transmission housing and the degree of precision with which it is machined. Since the transmissions therefore in fact consist of the torque converter as one element and the axial thrust bearing as the other element serving for taking up the grinding pressure, the overloading of only one element has frequently meant the breakdown of the whole system. The precision machining of the transmission housings, which presently reach a weight of up to approximately 100 tons gives rise to exacting requirements in manufacture and considered in isolation in fact represents an excessive cost factor. Even small inaccuracies in manufacture frequently lead to premature breakdown owing to the high loads involved. Transmissions have already been in use with operating loads of 575 Mp and dynamic additional loads of 2800 Mp.

One aim of the invention is accordingly that of divorcing the drive in the restricted sense, that is to say the torque converter or the torque producer on the one hand, from the axial thrust bearing system on the other hand. In this respect it was necessary to develop a construction of the axial thrust bearing system, which while fulfilling technical and economic requirements, made possible a further increase in the size of mills and therefore of their outputs. In order to attain this purpose it is necessary to sacrifice the previously demanded extremely high manufacturing accuracy in order to reduce costs without however simultaneously sacrificing operational reliability.

The use of hydrostatically lubricated bearings for taking up high loads has already been proposed. Hydrostatic bearings developed have included individual elements, which are used for other purposes. Such bearing elements cannot readily be used for roller mills. The invention therefore resides in so designing a roller mill that hydrostatic bearings can be employed, which are not organically and spatially tied to a transmission housing. Furthermore, there is the possibility of making a suitable selection of a certain number of bearing elements to allow adaptation to the loads, to be designed for in a particular application, which are produced by the grinding rollers.

In accordance with the invention the grinding pan is supported on at least three hydrostatic axial individual bearings, which with respect to the grinding pan are arranged substantially symmetrically and can take up all the vertical loads. These elements are combined with radial bearings elements, which are also hydrostatically lubricated and serve for guiding the grinding pan (in the case of conventional drives the grinding pan was guided by radial bearing of the transmission output drive shaft).

In a preferred embodiment of the invention a support ring (race ring) is arranged under the grinding pan and it distributes all vertical and horizontal loads, acting on the grinding pan, between the hydrostatic individual bearings. The latter transmits the loads directly to the foundation of the mill or, via the mill housing, onto the mill foundation so that preferably the drive parts and the transmission remain free of horizontal and vertical loads. In the case of the use of at least two grinding rollers there is the proposal of providing at least one pair of hydrostatic individual bearings for each grinding roller in such a manner that all individual bearings are arranged symmetrically with respect to the grinding pan and, respectively its axis. In accordance with the invention it is also possible to arrange a larger number of hydrostatic individual bearings symmetrically along a circular line, and in the case of the use of different bearings with different carrying capacities it is possible furthermore to vary the distance between the individual bearings. Furthermore, in accordance with the invention it is possible, in lieu of a support ring with horizontal and a vertical cylindrical race ring for support against axial bearings and separate radial bearings, to employ a support ring, which at its bearing race surface is machined so as to be conical or barrel-shaped. This ring would then be supported on obliquely set bearing elements, which owing to their oblique setting can take up both axial and also radial load components.

When hydrostatic bearings are used the invention has the aim of so developing the bearing elements that on using more than three individual elements, which ensure a statically determined supporting action, nevertheless all bearing elements are loaded evenly or approximately evenly; that is to say the bearing elements all possess a means for precision adjustment, with which they can be set as regards engagement on the race surface of the support ring. In the case of previously proposed construction a hydrostatic bearing can be vertically adjusted and is supported on a spherical cap member, while the latter is journalled with its holding means on a wedge plate, which can be displaced in the direction of its slope laterally using conventional means. In the case of another well known construction the setting of the hydrostatic bearings can be regulated hydraulically using a piston arrangement. In this case a respective main element and an auxiliary element are hydraulically linked with each other.

This possibility of adjustment is more especially necessary also because a less exacting precision machining of the bearing support system is to be dispensed with in order to reduce costs. The purpose is that of ensuring support of the bearing elements as far as possible with unmachined or cheaply produced parts. In one embodiment the welded mill housing is used for this purpose, while in another embodiment use is made for example of a concrete support means with a steel coping, on which the elements are attached.

The bearing arrangement in accordance with the invention finally provides the possibility of using drive members, which can be kept free of external forces. In one embodiment a high speed electric motor with a following transmission is arranged between the hydrostatic individual bearings for the purpose of producing a vertical drive. In another embodiment for drive as a direct drive system for the grinding pan use is made of a low speed electric motor without any torque converter, arranged in the mill housing between the hydrostatic bearings and in a still further embodiment, modified to depart from the last mentioned embodiment, a low speed electric motor is provided as a direct drive. It is arranged, without any torque converter, in the mill foundation below the mill. For the two different drives the axis of rotation of the grinding pan and the axis of rotation of the motor coincide so that there is symmetry around the axis of rotation between the support means and the drive.

BRIEF DESCRIPTION OF THE SEVERAL VIEWS OF THE DRAWINGS

In the accompanying drawings the invention is shown in greater detail wherein.

DETAILED DESCRIPTION

Figure 1:
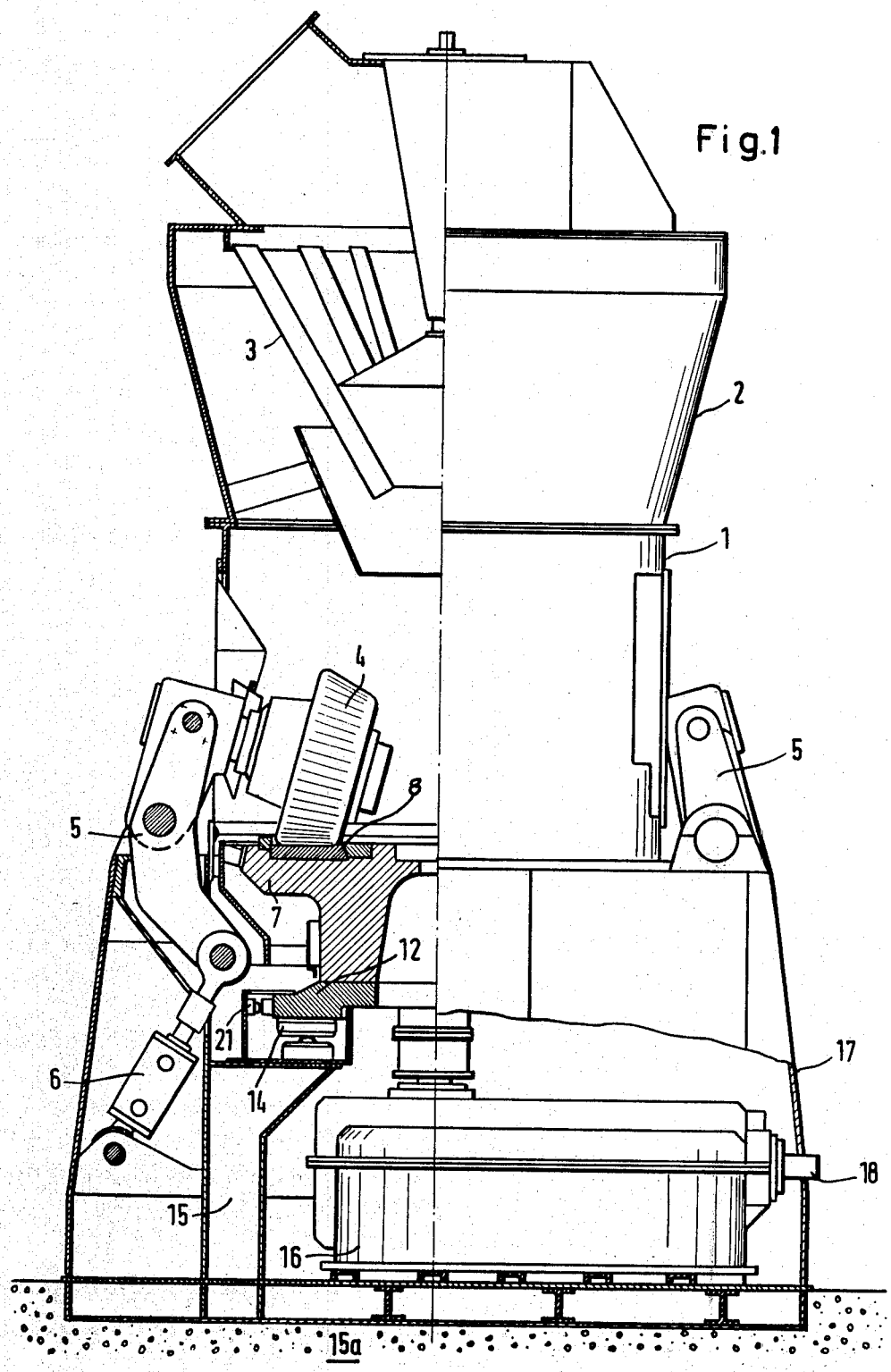
FIG. 1 shows a diagrammatic view of a roller mill in accordance with the invention, which is shown on the left in section and on the right in elevation. The drive is transmitted via a bevel spur gear-wheel vertical transmission, free of external forces, without any thrust bearing arrangement.

The roller mill represented in FIG. 1 comprises a housing 1 for receiving the grinding members and the classifier housing 2 for accepting the classifier rotor 3. The grinding members comprise the pivotally journalled grinding rolls 4, which by virtue of a pivoting lever 5 and a hydraulic cylinder 6 can be vertically pivoted. The grinding rollers run on a rotary grinding pan 7, which is armored with plates 8 of wear resistant material. The pressure or thrust cylinder 6 is provided with means for supplying hydraulic medium.

The roller mill in accordance with FIG. 1 is distinguished by the arrangement of a support ring (race ring) 12 beneath the grinding pan 7. This ring 12 transmits the vertical grinding forces and the horizontal guide forces to hydrostatically lubricated bearings 14 and 21 respectively. From this position the loads are passed on via the mill housing 15 (or directly via a support construction, not shown here, divorced from the mill housing) to the foundation 15*a*. The lower part of the roller mill with the transmission 16 is accommodated in a housing casing 17. The drive via the transmission 16 is from the outside via a shaft 18. The lower housing part 17 is so constructed that it forms a support for the grinding rollers 4 with the pivoting levers 5 as will be more especially apparent from the part of FIG. 1 on the right.

Figure 2:
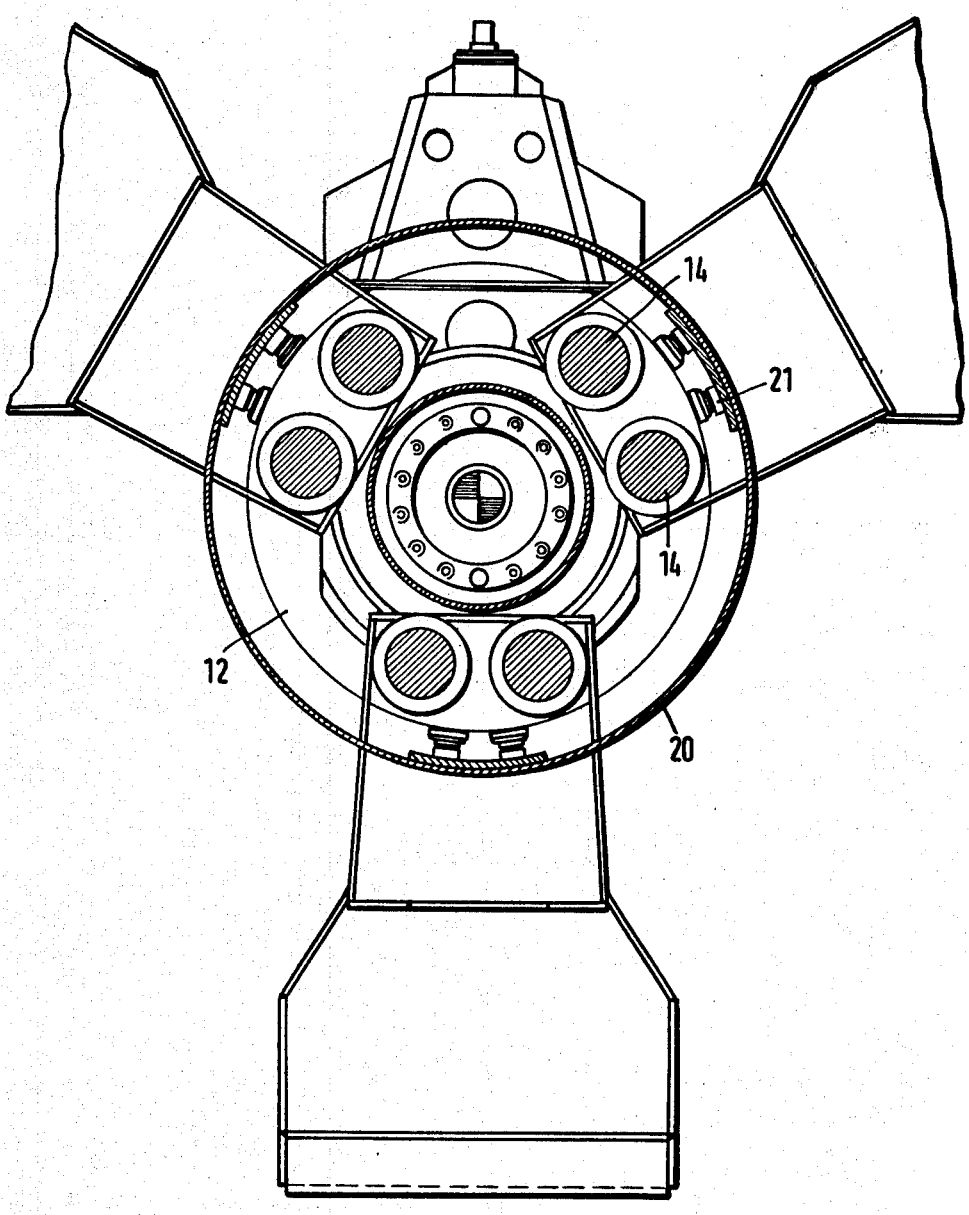
FIG. 2 shows diagrammatically a plan view showing the bearing arrangement of a grinding pan with three grinding rollers having hydrostatic axial and radial bearings for them.

FIG. 2 shows diagrammatically the disposal of hydrostatic bearings 14, which are respectively arranged in pairs, that is to say one pair for each grinding roller. This representation furthermore shows in a very clear manner the lateral support of the supporting ring 12 on the housing part 20, whose arrangement will be gathered from FIG. 1. The hydrostatic bearings for the lateral support are denoted by reference numeral 21. As regards understanding the drawing it is to be noted that the outline of the support ring is designated by a thin line, because the support ring is located above the hydrostatic bearing 14 and is in fact not visible.

Figure 3:
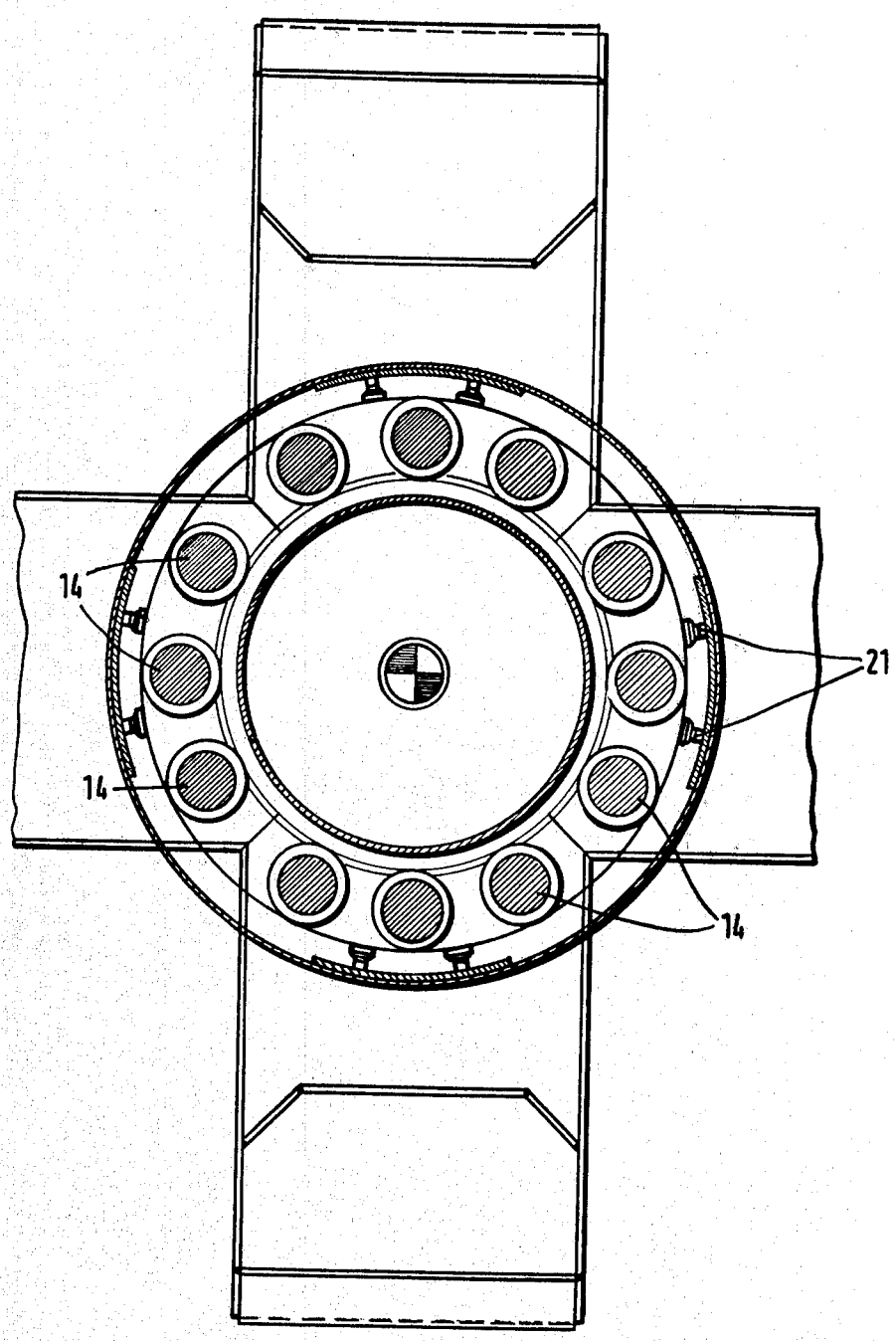
FIG. 3 shows in the view resembling that in FIG. 3 several hydrostatic bearings, arranged in an annular configuration, for four grinding rollers.

FIG. 3 shows an embodiment in which the hydrostatic bearings 14 are arranged along a circular line, there being in this case three respective bearings for one grinding roller. The construction shown is a mill with four rollers. In other respects the view corresponds to that of FIG. 2.

Figure 4:
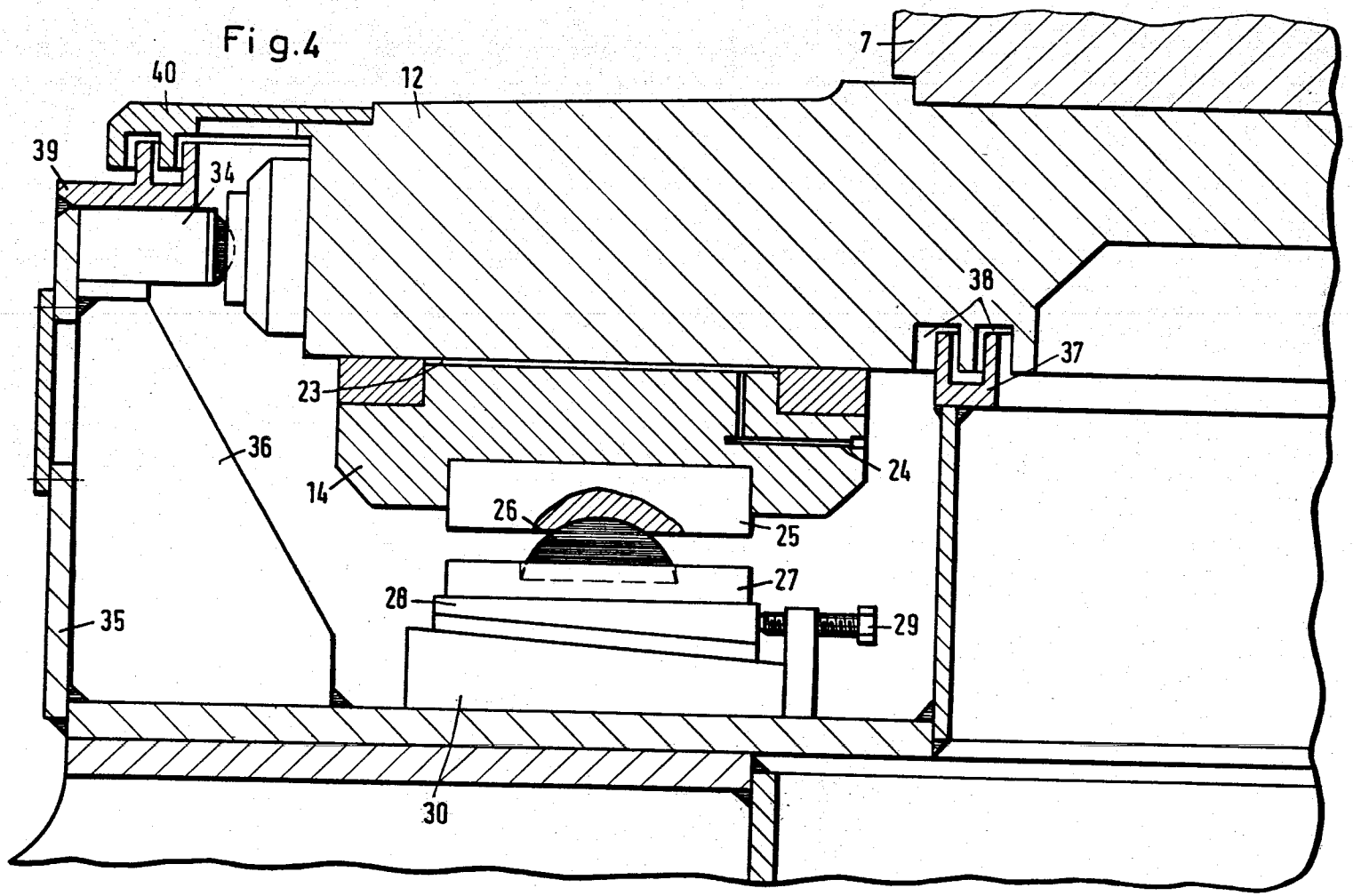
FIG. 4 shows diagrammatically in cross section an axial hydrostatic bearing with means for vertical adjustment and furthermore lateral adjustment of a second hydrostatic bearing for radial support of the support ring.

FIG. 4 shows the embodiment of an axial hydrostatic bearing, which is vertically adjustable by the use of an adjusting device having inclined or wedge surfaces.

The view shows the support ring 12, which is carried by a hydrostatic bearing 14. The drawing shows the thrust or pressure surface 23, which is supplied with a pressure medium via the supply duct 24. On the lower side the bearing has an inserted thrust plate 25, which has a recess for a hemisphere 26. The hemisphere 26 is arranged in a plate 27, which rests on a shifting wedge 28, which can be shifted for setting from the side by means of a setting screw 29. Underneath the wedge plate 28 there is a further support plate 30, whose inclination is arranged to ascend to the left. It will readily be understood that the arrangement represented makes possible a very precise setting of the hydrostatic bearing 14 vertically.

These support plates 30 of all bearing elements are supported on the housing 35, which owing to the adjustment of the bearing elements with respect to the support ring 12 do not have to be machined at all or at the most only have to be machined roughly. The housing 35 is constructed as an annular trough in order to catch the oil leaking from the bearing at the thrust surface 23. The housing 35 has at its internal diameter a labyrinth ring 37, which fits into corresponding grooves 38 of the support ring 12 for sealing and at the external diameter it has a labyrinth ring 39, which fits into a corresponding labyrinth ring 40. The labyrinth ring 40 rotates with the support ring 12 and the grinding pan 7. Laterally from the support ring 12 there is shown a further support bearing (radial guide) 34, which can also be adjusted. Several bearings 34 of this type serve to hold the support ring 12 in a certain position, that is to say they are guided radially.

The embodiments of the invention in which an exclusive property or privilege is claimed are as follows:

1. A roller mill of the type having a housing structure supported on a foundation, a substantially horizontal grinding pan supported for rotation about a substantially vertical mill axis, at least one grinding roller supported by pivotable journals for rolling contact on the grinding pan, means to pivot the rotational axis of the roller to move the roller into and out of engagement with the grinding pan, and driving means below the grinding pan to rotate the grinding pan, comprising, the grinding pan having a horizontal pan section and an integral substantially vertical depending section, a support ring in contact with the lower end of said depending section and having a larger diameter than said depending section to extend radially therebeyond, at least three hydrostatic bearings symmetrically arranged for supporting said support ring at said radially extending location for coaxial rotation with said grinding pan, at least three radial hydrostatic bearings symmetrically arranged to guide said support ring radially, each bearing being adjustably mounted on a base support element of the housing structure so that they distribute the entire load of the grinding operation through the grinding pan, support ring, and base support elements to the foundation, said base support elements being radially outwardly spaced with respect to said mill axis so that said driving means is readily accessible when in operating position.

2. The roller mill as claimed in claim 1 wherein said radial bearings are adjustably mounted on said base support elements at the periphery of said support ring.

3. The roller mill as claimed in claim 2 wherein said support ring has a bearing surface on its periphery with which said radial bearing engages.

4. The roller mill as claimed in claim 3 wherein said periphery of said support ring is a cylindrical surface.

5. The roller mill as claimed in claim 3 wherein said adjustable mounting for each said radial bearing comprises a wedge member slidably engaging on one face thereof an inclined surface on a first plate member mounted on said base support and on the other face thereof, a cooperating surface on a second plate member, a hemisphere mounted on the other side of said second plate member facing said periphery of said support ring, a thrust plate on the radially outermost surface of said radial bearing having a hemispherical concave surface engaging in cooperative relationship with said hemisphere, and means to move said wedge member to radially adjust said hemisphere.

6. A roller mill as claimed in claim 3 wherein said adjustable mounting for each said radial bearing comprises a hemispherical bearing between said hydrostatic bearing and said base support element and means to radially adjust said hemispherical bearing.

* * * * *